US009943773B2

(12) United States Patent
Li et al.

(10) Patent No.: US 9,943,773 B2
(45) Date of Patent: Apr. 17, 2018

(54) PLATFORM DYNAMIC VEHICLE

(71) Applicant: SHENZHEN OCT VISION INC., Shenzhen (CN)

(72) Inventors: Jian Li, Shenzhen (CN); Hongguang Wen, Shenzhen (CN); Baoluo Jia, Shenzhen (CN)

(73) Assignee: SHENZHEN OCT VISION INC., Shenzhen (CN)

( * ) Notice: Subject to any disclaimer, the term of this patent is extended or adjusted under 35 U.S.C. 154(b) by 56 days.

(21) Appl. No.: 15/108,741

(22) PCT Filed: Dec. 17, 2014

(86) PCT No.: PCT/CN2014/094017
§ 371 (c)(1),
(2) Date: Jun. 28, 2016

(87) PCT Pub. No.: WO2015/101179
PCT Pub. Date: Jul. 9, 2015

(65) Prior Publication Data

US 2016/0317942 A1 Nov. 3, 2016

(30) Foreign Application Priority Data

Dec. 30, 2013 (CN) ..... 2013 1 0742334

(51) Int. Cl.
*A63J 5/00* (2006.01)
*A63J 25/00* (2009.01)
(Continued)

(52) U.S. Cl.
CPC ..... *A63J 5/00* (2013.01); *A63G 31/02* (2013.01); *A63G 31/16* (2013.01); *A63J 5/12* (2013.01);
(Continued)

(58) Field of Classification Search
CPC . A63G 1/00; A63G 1/10; A63G 19/00; A63G 31/00; A63G 31/06; A63H 33/00; A63H 33/22; G09B 9/00; G09B 9/12
See application file for complete search history.

(56) References Cited

U.S. PATENT DOCUMENTS 4,885,878 A * 12/1989 Wuu ..... E04H 3/126 348/121
5,114,154 A * 5/1992 Sellner ..... A63H 5/04 273/367
(Continued)

FOREIGN PATENT DOCUMENTS

CN 101912689 A 12/2010
CN 102755755 A 10/2012
(Continued)

OTHER PUBLICATIONS

The World Intellectual Property Organization (WIPO) International Search Report for PCT/CN2014/094017 dated Mar. 13, 2015.

*Primary Examiner* — Jason C Smith
(74) *Attorney, Agent, or Firm* — Anova Law Group, PLLC

(57) ABSTRACT

A platform dynamic vehicle, comprising a vehicle body (100), the vehicle body (100) moving on a rail track by means of vehicle wheels (110) on the bottom of the vehicle body, a bracket (200) being arranged vertically on the vehicle body (100), the upper part of the bracket (200) being connected movably to a viewing platform (400), a plurality of rows of viewing seats (300) being disposed on the viewing platform (400), a seat drive apparatus used for driving the viewing seats (300) to tilt forwards or recline backwards being disposed on the viewing seats (300), a platform drive apparatus used for driving the viewing platform (400) to rotate on the X axis, Y axis, and Z axis being disposed on the viewing platform (400), and a vehicle drive
(Continued)

apparatus used for driving the vehicle body (100) to move along the rail track being disposed on the vehicle body (100). When seating in the dynamic vehicle, viewers can change viewing position with the movement of the vehicle body, thereby changing the viewing space, and the viewing platform (400) and viewing seats (300) can also move, such that the viewer can obtain more viewing space and a larger viewing range.

4 Claims, 5 Drawing Sheets

(51) Int. Cl.
*A63G 31/16* (2006.01)
*A63G 31/02* (2006.01)
*A63J 5/12* (2006.01)

(52) U.S. Cl.
CPC ..... *A63J 25/00* (2013.01); *A63J 2005/002* (2013.01)

(56) References Cited

U.S. PATENT DOCUMENTS 6,017,276 A * 1/2000 Elson ..... A63G 31/16 434/29
6,053,576 A * 4/2000 Jessee ..... A63G 31/16 297/232
6,095,926 A * 8/2000 Hettema ..... A63G 31/16 104/85
6,533,670 B1 * 3/2003 Drobnis ..... A63G 31/16 434/55
6,665,985 B1 * 12/2003 Hennes ..... E04H 3/22 352/69
7,033,177 B2 * 4/2006 Kim ..... G09B 9/12 434/29
7,094,157 B2 * 8/2006 Fromyer ..... A63G 31/12 434/55
8,453,579 B2 * 6/2013 Nemeth ..... A63G 3/00 104/53
8,641,540 B2 * 2/2014 Feuer ..... A63G 7/00 434/55
9,084,941 B1 * 7/2015 Fram ..... A63G 31/16
9,272,224 B2 * 3/2016 Nemeth ..... A63G 7/00
9,731,217 B2 * 8/2017 Li ..... A63J 5/12
9,757,658 B1 * 9/2017 Kaufmann ..... A63G 31/16
2005/0014566 A1 * 1/2005 Hashimoto ..... A63G 31/16 472/59
2005/0014567 A1 * 1/2005 Li ..... A63G 31/16 472/60
2013/0144468 A1 * 6/2013 Foster ..... B62D 3/00 701/2
2015/0065260 A1 * 3/2015 Beyr ..... A63G 31/16 472/60
2016/0317943 A1 * 11/2016 Li ..... A63G 31/16
2016/0325201 A1 * 11/2016 Li ..... A63G 31/16
2017/0072327 A1 * 3/2017 Wach ..... A63G 31/16
2017/0080353 A1 * 3/2017 Li ..... A63J 5/12
2017/0113150 A1 * 4/2017 Lee ..... A63F 13/28
2017/0266572 A1 * 9/2017 Petrov ..... A63G 31/16

FOREIGN PATENT DOCUMENTS

CN 203160750 U 8/2013
CN 103691134 A 4/2014

* cited by examiner

PLATFORM DYNAMIC VEHICLE

CROSS-REFERENCES TO RELATED APPLICATIONS

This application is a national stage application of PCT Patent Application No. PCT/CN2014/094017, filed on Dec. 17, 2014, which claims priority to Chinese Patent Application No. 201310742334.1, filed on Dec. 30, 2013, the content of all of which is incorporated herein by reference.

FIELD OF THE INVENTION

The present invention relates to the field of viewing apparatus, and more particularly, to a platform dynamic vehicle.

BACKGROUND

In the current technologies, a viewing platform is usually fixed, that is, after a viewer has sat down on the viewing platform, which is fixed, and the viewer's moving feeling comes from the movement of his seat, thus, by this way, the viewer himself is not movable, which has limited the viewing space and viewing range of the viewer.

Therefore, the current technology needs to be improved and developed.

BRIEF SUMMARY OF THE DISCLOSURE

According to the above described defects, the purpose of the present invention is providing a platform dynamic vehicle, in order to solve the problems of the viewing platforms in a viewing device are fixed and unable to make the viewers move in the prior art, which has limited the viewing spaces and viewing ranges of viewers.

In order to achieve the above mentioned goals, the technical solution of the present invention to solve the technical problems is as follows:

a platform dynamic vehicle, wherein, it comprises a vehicle body, the said vehicle body moves on a rail track by means of vehicle wheels on the bottom of the vehicle body, a bracket is arranged vertically on the vehicle body, the upper part of the bracket is connected movably to a viewing platform, a plurality of rows of viewing seats are disposed on the viewing platform, a seat drive apparatus used for driving the viewing seats to tilt forwards or recline backwards is disposed on the viewing seats, a platform drive apparatus used for driving the viewing platform to rotate on the X axis, Y axis, and Z axis is disposed on the viewing platform, and a vehicle drive apparatus used for driving the vehicle body to move along the rail track is disposed on the vehicle body.

The said platform dynamic vehicle, wherein, the said seat drive apparatus is an electric power driven, a hydraulic driven or a pneumatic driven apparatus.

The said platform dynamic vehicle, wherein, the said viewing seats are arranged in two rows.

The said platform dynamic vehicle, wherein, the said two rows of viewing seats are divided into two layers, an upper layer and a lower layer.

Benefits: the present invention arranges a bracket vertically on a vehicle body, and the upper part of the bracket is connected in a rotatable way to a viewing platform, a seat drive apparatus used for driving the viewing seats to tilt forwards or recline backwards is disposed on the viewing seats, a platform drive apparatus used for driving the viewing platform to rotate on the X axis, Y axis, and Z axis is disposed on the viewing platform, and a vehicle drive apparatus used for driving the vehicle body to move along the rail track is disposed on the vehicle body. In such a way, viewers can change their viewing positions following the movement of the vehicle body, thereby changing the viewing space, and both the viewing platform and viewing seats can also move, which has changed the traditional viewing method, such that the viewers can obtain more viewing space and a larger viewing range.

DETAILED DESCRIPTION OF EMBODIMENTS

The present invention provides a platform dynamic vehicle, in order to make the purpose, technical solution and the advantages of the present invention clearer and more explicit, further detailed descriptions of the present invention are stated here, referencing to the attached drawings and some embodiments of the present invention. It should be understood that the detailed embodiments of the invention described here are used to explain the present invention only, instead of limiting the present invention.

Figure 1:
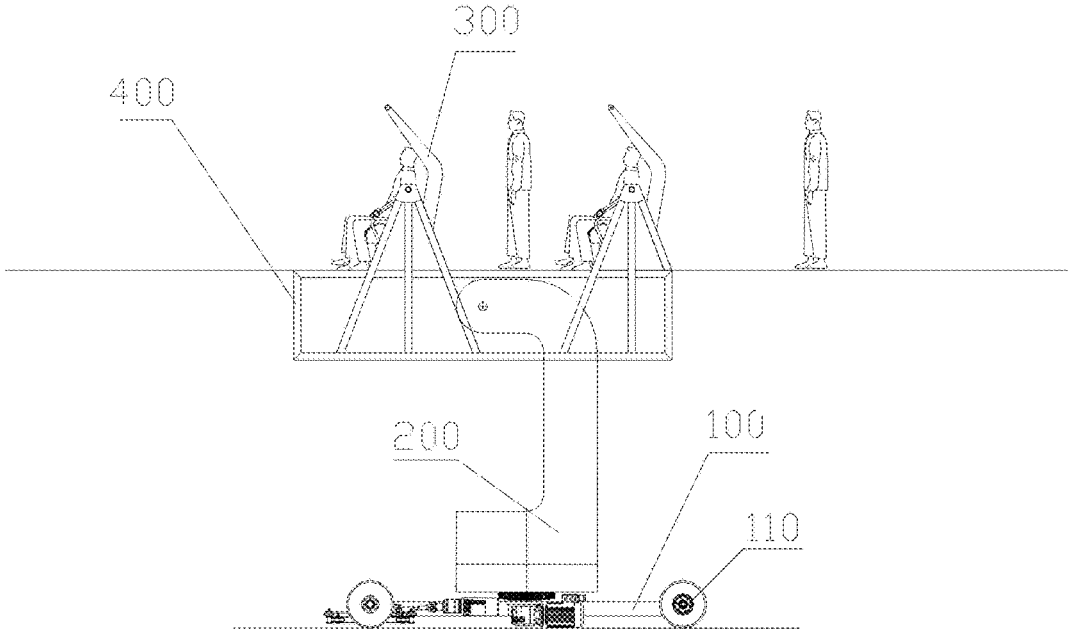
FIG. 1 illustrates a schematic diagram of the platform dynamic vehicle in a preferred embodiment as provided in the present invention, when viewers are boarding the platform dynamic vehicle.
Figure 2:
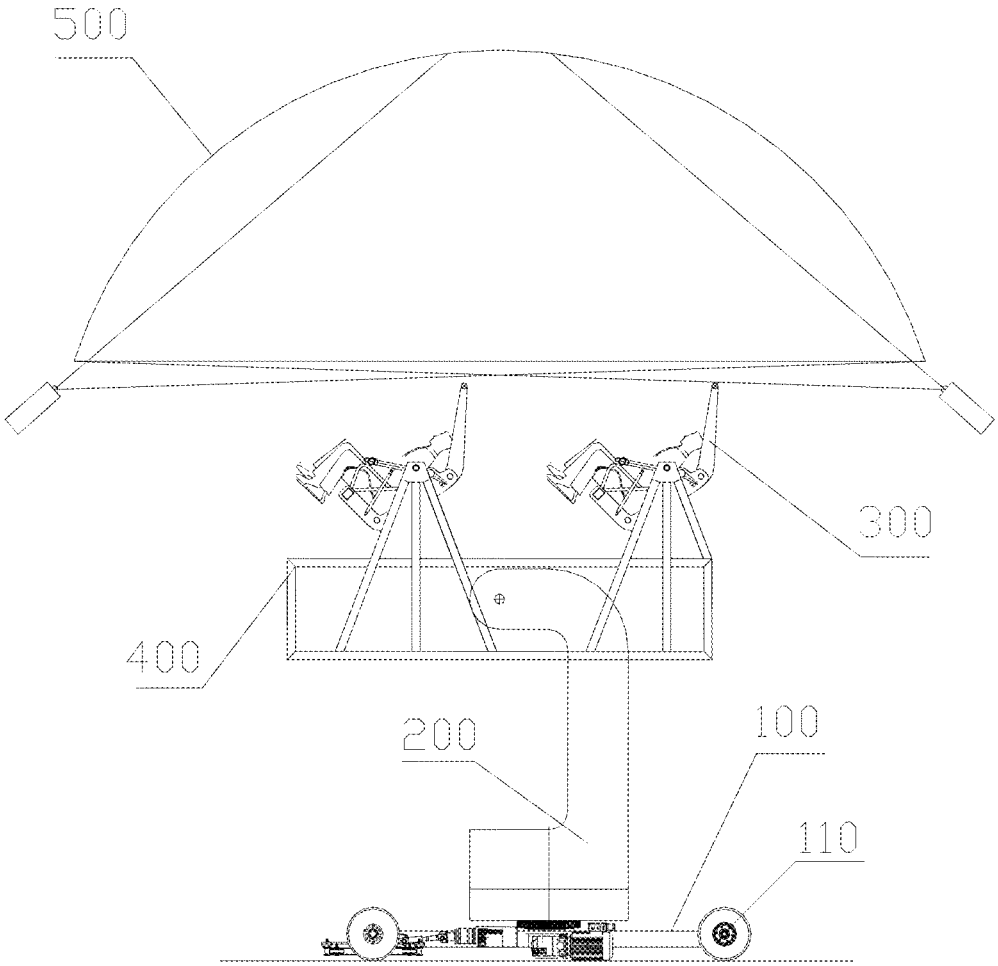
FIGS. 2-5 illustrate schematic diagrams on different statuses when viewers are viewing, as provided in a preferred embodiment in the present invention on a platform dynamic vehicle.
Figure 3:
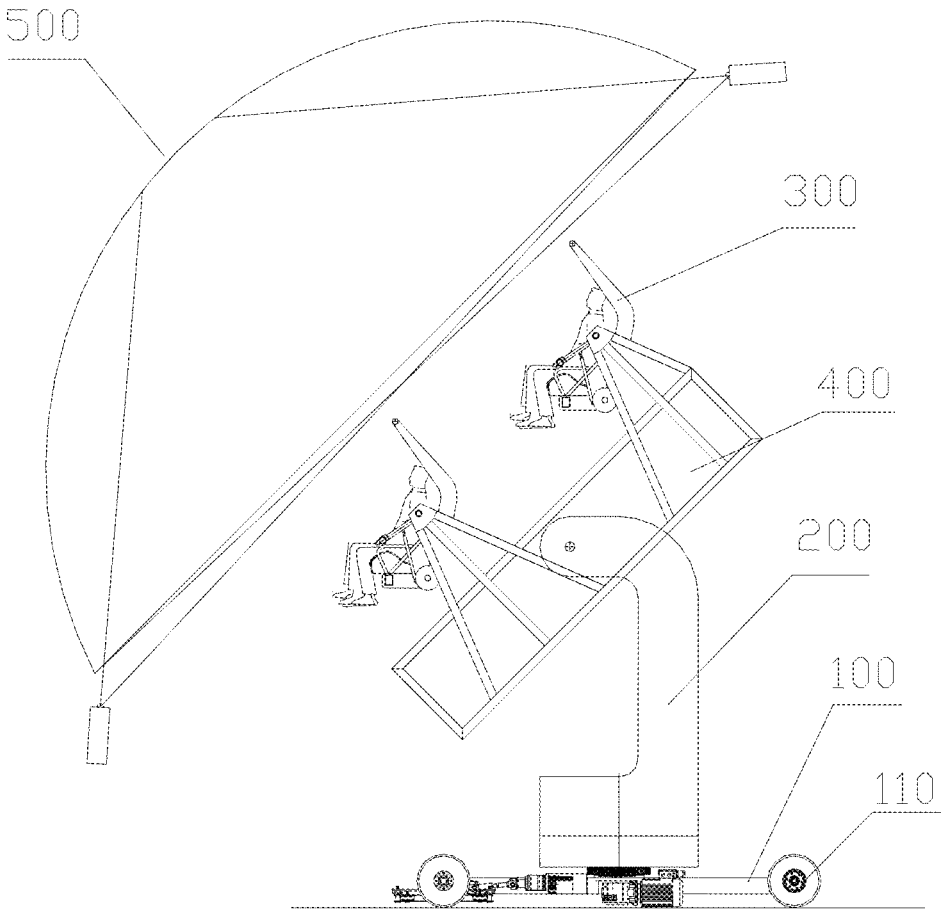
Figure 4:
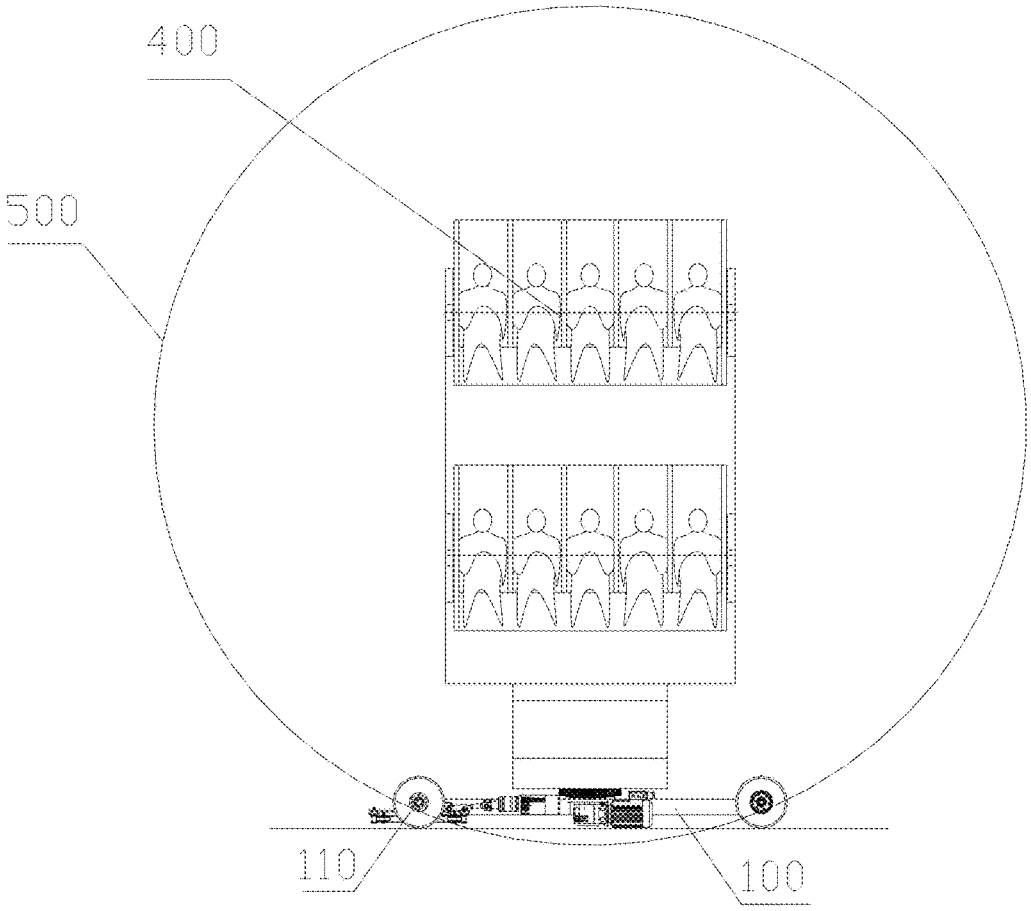
Figure 5:
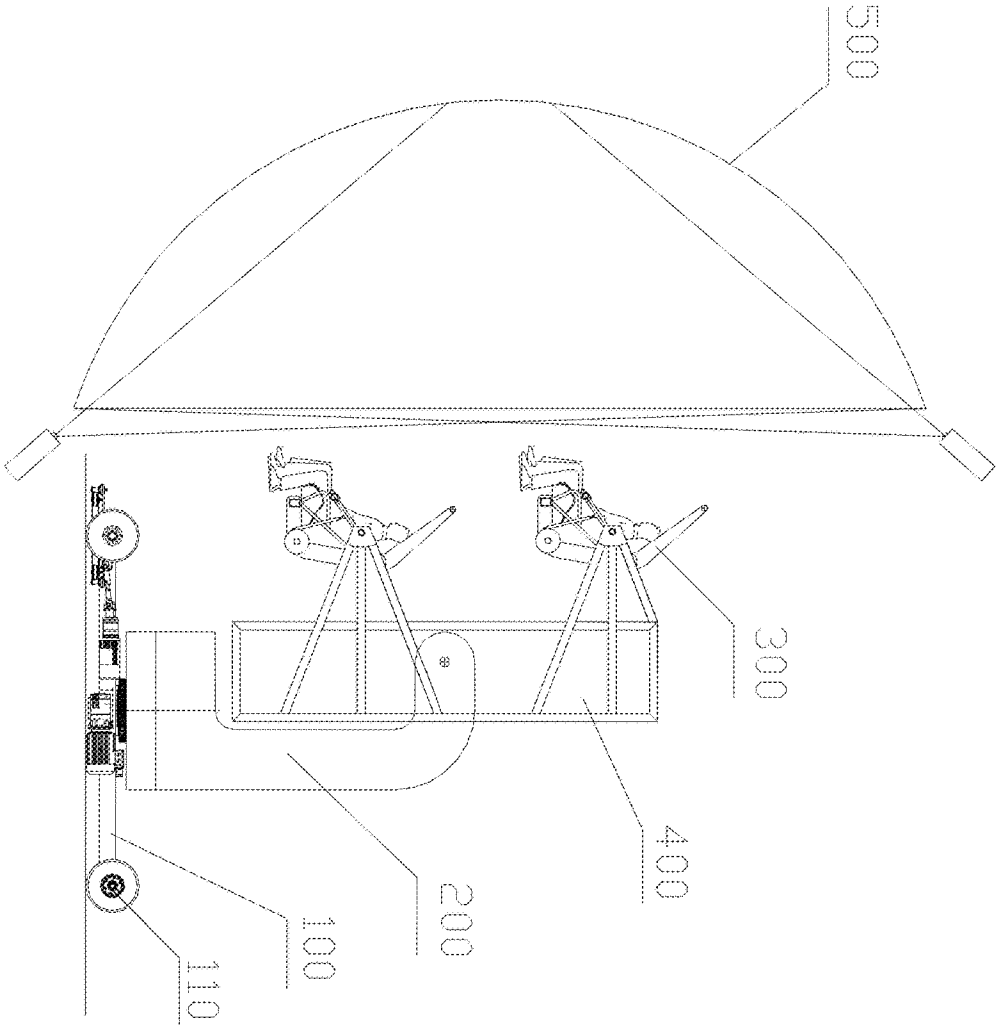

Referencing to FIG. 1, which illustrates a schematic diagram of the platform dynamic vehicle in a preferred embodiment as provided in the present invention, as shown in FIG. 1, it comprises a vehicle body 100, the said vehicle body 100 moves on a rail track by means of vehicle wheels 110 on the bottom of the vehicle body 100, a bracket 200 is arranged vertically on the vehicle body 100, the upper part of the bracket 200 is connected movably to a viewing platform 400, a plurality of rows of viewing seats 300 are disposed on the viewing platform 400, a seat drive apparatus used for driving the viewing seats 300 to tilt forwards or recline backwards is disposed on the viewing seats 300, a platform drive apparatus used for driving the viewing platform 400 to rotate on the X axis, Y axis, and Z axis is disposed on the viewing platform 400, and a vehicle drive apparatus used for driving the vehicle body 100 to move along the rail track is disposed on the vehicle body.

In the present invention, the vehicle body 100 may move to a certain scene following the rail track, to watch movie contents on shown in an oblique screen, an upright screen, or a circle screen. The body drive apparatus of the vehicle body 100 may further drive the vehicle body 100 to achieve more actions such as: acceleration, deceleration, braking, stop and more, to make it match the scenes of the video pictures.

The said viewing platform 400, viewing seats 300 and the vehicle body 100 are all movable, and able to adjust the viewing positions and viewing directions of the viewers, as shown in FIGS. 2-5, thus bring more viewing spaces and larger viewing ranges to viewers.

Further, the said seat drive apparatus is an electric power driven, a hydraulic driven or pneumatic driven apparatus.

As shown in FIG. 1, the said viewing seats 300 are arranged in two rows, and both rows of seats are arranged in two layers, an upper layer and a lower layer, each row is arranged with 5 viewing seats. Of course, in real applications, the rows of the viewing seats may be adjusted following real requirements; all these changes and substitutions belong to the protection scope of the present invention.

Height of the said bracket 200 may be set as 10 meters, and the width may be set as 5 meters, while the distance between the upper and lower rows of the viewing seats 300 may be set as 1 meter, and the projection devices may be set at the center between the upper and lower rows. The said seat drive apparatus further connects to a synchronization mechanism, applied to control the seat drive apparatus make the synchronization actions, following the actions played in the video pictures from the projection devices, for example, when the current video pictures shake from left to right, or shake from upper to lower, the synchronization mechanism will control the said seat drive apparatus swing from left to right, or swing from upper to lower, therefore, make the viewing seats generate the same actions, while the amplitude, frequency and more are synchronizing with the video pictures.

When the present invention is in operation, viewers sit in the viewing seats 300 on the viewing platform 400, and tie the seat belts and press the safety level, the viewing seats 300 will turn to an almost level position, under the drive of the seat drive apparatus, the projection devices will start to play videos, and project to a spherical screen 500 (shown as FIGS. 2-5), both pivot and rotation points of the viewing platform 400 locate at the center of the spherical screen 500, the viewing platform 400 may turn lower to a maximum of 90 degrees, according to the scenes in the movie, and may rotate n*360 degrees around the Z axis at the same time, while the viewing seats 300 locate in a vertical position, except for its self rotations, however, when needed, they may make actions such as pitching actions according to the movie contents, and when the movie is finished, they may return to their original positions. The said spherical screen 500 may also be arranged into a half-spherical screen, and the projection devices may also be facing to the specific hemispherical screen.

All above, the present invention arranges a bracket vertically on the vehicle body, and the upper part of the bracket is connected in a rotatable way to a viewing platform, a seat drive apparatus used for driving the viewing seats to tilt forwards or recline backwards is disposed on the viewing seats, a platform drive apparatus used for driving the viewing platform to rotate on the X axis, Y axis, and Z axis is disposed on the viewing platform, and a vehicle drive apparatus used for driving the vehicle body to move along the rail track is disposed on the vehicle body. In such a way, viewers can change their viewing positions following the movement of the vehicle body, thereby changing the viewing space, and both the viewing platform and viewing seats can also move, which has changed the traditional viewing method, such that the viewers can obtain more viewing space and a larger viewing range.

It should be understood that, the application of the present invention is not limited to the above examples listed. Ordinary technical personnel in this field can improve or change the applications according to the above descriptions, all of these improvements and transforms should belong to the scope of protection in the appended claims of the present invention.

What is claimed is:

1. A platform dynamic vehicle, wherein, it comprises a vehicle body, the vehicle body moves on a rail track by means of vehicle wheels on the bottom of the vehicle body, a bracket is arranged vertically on the vehicle body, the upper part of the bracket is connected movably to a viewing platform, a plurality of rows of viewing seats are disposed on the viewing platform, a seat drive apparatus used for driving the viewing seats to tilt forwards or recline backwards is disposed on the viewing seats, a platform drive apparatus used for driving the viewing platform to rotate on the X axis, Y axis, and Z axis is disposed on the viewing platform, and a vehicle drive apparatus used for driving the vehicle body to move along the rail track is disposed on the vehicle body.

2. The platform dynamic vehicle according to claim 1, wherein, the seat drive apparatus is an electric power driven, a hydraulic driven or pneumatic driven apparatus.

3. The platform dynamic vehicle according to claim 1, wherein, the viewing seats are arranged in two rows.

4. The platform dynamic vehicle according to claim 3, wherein, the two rows of viewing seats are divided into two layers, an upper layer and a lower layer.

* * * * *